US006318567B1

(12) United States Patent
Braley

(10) Patent No.: US 6,318,567 B1
(45) Date of Patent: Nov. 20, 2001

(54) UNDERCABINET CULINARY INSTRUMENT RACK

(76) Inventor: John V Braley, 43 Dick Finn Rd., New Fairfield, CT (US) 06812

( * ) Notice: Subject to any disclaimer, the term of this patent is extended or adjusted under 35 U.S.C. 154(b) by 0 days.

(21) Appl. No.: 09/548,092

(22) Filed: Apr. 12, 2000

(51) Int. Cl.[7] ..... A47F 7/00; A47G 21/14

(52) U.S. Cl. ..... 211/70.7; 248/37.3; 211/150; 211/169.1

(58) Field of Search ..... 211/70.7, 60.1, 211/96, 119.005, 126.15, 129.1, 131.1, 150, 166, 168, 169.1, 174, 175; 248/37.3, 37.6, 320–325; 108/1, 6, 8, 9, 137, 142; 312/210.5, 902; 206/349; D8/71–73, 349

(56) References Cited

U.S. PATENT DOCUMENTS

| | | | | |
|---|---|---|---|---|
| 1,701,062 | | 2/1929 | Burnham . | |
| 2,203,008 | * | 6/1940 | Bauman . | |
| 2,839,349 | * | 6/1958 | Culver . | |
| 2,903,211 | * | 9/1959 | Weinstock | 248/37.6 |
| 3,857,623 | * | 12/1974 | Schneller . | |
| 3,915,213 | | 10/1975 | Graham, Jr. . | |
| 4,150,861 | * | 4/1979 | Dufrancatel | 312/269 |
| 4,305,629 | * | 12/1981 | Friis | 248/37.3 |
| 4,314,734 | * | 2/1982 | Grunert | 108/1 |
| 4,441,771 | * | 4/1984 | Roesler . | |
| 4,511,040 | | 4/1985 | Tolentino . | |
| 4,979,610 | | 12/1990 | Thomas . | |
| 5,244,272 | * | 9/1993 | Thompson | 211/126.15 |
| 5,494,176 | * | 2/1996 | Zallo | 211/70.7 |
| 5,553,724 | * | 9/1996 | Moher et al. | 211/70.7 |
| 5,584,404 | * | 12/1996 | Tsai | 211/94.01 |
| 5,707,034 | * | 1/1998 | Cotterill . | |
| 5,725,108 | * | 3/1998 | Olson | 211/70.1 |
| 5,957,558 | * | 9/1999 | Qhade . | |

* cited by examiner

*Primary Examiner*—Daniel P. Stodola
*Assistant Examiner*—Jennifer E. Novosad
(74) *Attorney, Agent, or Firm*—Michael I. Kroll

(57) ABSTRACT

A culinary instrument storage and access device that installs under a cabinet or a shelf. The rack is secured in stowed position by a snap-in latch, which is pulled to release. It is suspended from four swing down hinges installed under the cabinet, which allow the device to be in a down position for access, or an upper stowed position. The device is suspended high enough above the countertop so as not to present an obstacle within the work area even when in the down position. When moved to the stowed position, it can be latched by pushing it back and up into the locked position under the cabinet. The preferred embodiment of the cutlery rack configuration includes a base platform upon which a smaller rectangular knife rack is centrally disposed made of rock maple wood, into which a plurality of slots for holding dinner knives has been introduced. Symmetrically disposed on either side of the cutlery rack are arrays of u-shaped holders for forks and spoons, respectively. Other embodiments include flatware holders that grasp the handles of the flatware, and a device devoted exclusively to cutlery with a correspondingly larger cutlery rack. An alternate base is provided that includes a front portion, sized to be flush to the cabinet underside, when the base is in the stowed position. In kitchens where the cabinets have no underside recess to conceal the device, this front portion serves the purpose of concealing the device from a frontal view.

10 Claims, 9 Drawing Sheets

UNDERCABINET CULINARY INSTRUMENT RACK

BACKGROUND OF THE INVENTION

1. Field of the Invention

The present invention relates generally to storage devices and, more specifically, to cutlery and eating utensil storage devices. Storage devices typical in this field are generally adapted for drawer, wall, inside cabinet, overhead or countertop installation and usage. While each of these areas may be somewhat suitable for such installations they are all less than optimum locations for cutlery and eating utensil storage. Drawers must be opened and closed each time to access utensils. Leaving a drawer open for any length of time creates an obstacle and a traffic hazard in moving about the kitchen work area. Likewise, cabinet doors must be opened and closed or left open to create another obstacle. Wall space for utensils is usually not in a convenient place and may be awkward to use requiring significant reaching over deep countertops. Overhead installations have similar drawbacks requiring repeated and excessive reaching motion, which can be annoying and tiring. The present invention overcomes these obstacles by providing an eating utensil and cutlery storage rack that installs under a cabinet, a good location for constant usage. It can be mounted to the left, to the right or directly over the sink. There are several other advantages. Stowing the rack in the undercabinet recess keeps it out of the way as well as out of sight but still in a place that requires a minimum of movement or effort to access. The rack is secured in stowed position by a snap in lock that is pulled to release and is suspended from swing down hinges installed under the cabinet. This swing down feature offers an additional advantage, i.e.; even when it is deployed it does not generally present an obstacle to the work area and can be kept open for continual use with little adverse effects. If it should occasionally present an obstacle it can be easily stowed by simply pushing it up which automatically locks it in place under the cabinet. This action requires very little effort or actual physical motion. The present invention therefore provides not only a novel and elegant solution to one problem of kitchen storage but represents a significant improvement in the overall working and living environment of one of the most important rooms in the home.

2. Description of the Prior Art

There are other storage devices designed for the kitchen work area. Typical of these is U.S. Pat. No. 1,701,062 issued to C. W. Burnham on Feb. 5, 1929.

Another patent was issued to Erik P. Thomas on Dec. 25, 1990 as U.S. Pat. No. 4,979,610. Yet another U.S. Pat. No. 4,511,040 was issued to John Tolentino on Apr. 16, 1985 and still yet another was issued on Oct. 28, 1975 to Norman Graham, Jr., as U.S. Pat. No. 3,915,213.

U.S. Pat. No. 1,701,062

Inventor: Chester W. Burnham

Issued: Feb. 5, 1929

A rack is provided which may be used for knives, etc., of a four-person set or an eight-person set etc. The rack has notches which are so shaped they will receive and snugly hold and support either knives, for example, in the usual edgewise or substantially vertical position, or forks, spoons, etc., in the usual flatwise or horizontal position. The notches are adapted for so receiving a knife or a fork or the like by cutting away one wall of the notch so as to provide a seat or shelf midway of its depth on which the shank of the fork or the like may rest flatwise and by providing a seat at the lower end of the notch on which a knife, for example, may be supported edgewise. The rack is adaptable for use from a four-person set to an eight-person set by simply utilizing as many of the multipurpose or universal holders as required.

U.S. Pat. No. 4,979,610

Inventor: Erik P. Thomas

Issued: Dec. 25, 1990

A case for instruments, such as knives and other culinary instruments, comprises a base portion including first and second hingeably connected base portion sections, a cover portion including first and second cover portion sections which are hingeably connected to the first and second base portion sections, respectively, and a positioning member which is operatively for receiving and releasably securing instruments in the base portion. The case is alternately positionable in a closed position wherein the cover portion sections are received on the base portion sections, an open position wherein the cover portion sections are hinged outwardly from the base portion sections, or a workstation position wherein the second base portion section and the second cover portion section are hinged outwardly to positions wherein they are operative for supporting the first base portion section in an angular disposition on a supporting surface so that instruments can be readily removed from the first base portion section as needed.

U.S. Pat. No. 4,511,040

Inventor: John Tolentino

Issued: Apr. 16, 1985

A compact case for displaying and storing cutlery or related articles. The case includes a container with a forward display portion and a rear storage portion, separated by a divider. A series of storage blocks for carrying cutlery are positioned within the rear storage portion, and cutlery support frames are mounted on the divider. Each cutlery support frame includes a vertical backplate with a horizontal tab extending therefrom. A support clip is pivotally attached by one end to each backplate. The storage blocks are elongated blocks having a plurality of thin slots oriented transverse to the longer side of each block, and further having a plurality of passageways parallel to the slots. The blocks also have a plurality of tabs extending from the block between the slots and parallel to the slots, with the tabs tapering away from the slots to form a guide for cutlery handles.

U.S. Pat. No. 3,915,213

Inventor: Norman Graham, Jr.

Issued: Oct. 28, 1975

A utility holder for storing one place setting of silverware with individual compartments that are each shaped in mating engagement with the stored item of silverware so that the individual pieces of silverware do not touch one another. The handle of each piece of silverware is locked into position by a notch in the top end side of the utility holder, said notch being of a size and shape to anchor the handle of the piece of silverware. The unit may consist of three or more compartments with each compartment designed to hold one of the pieces of a unit place setting of a set of silverware.

While these storage devices may be suitable for the purposes for which they were designed, they would not be as suitable for the purposes of the present invention, as hereinafter described.

SUMMARY OF THE PRESENT INVENTION

A primary object of the present invention is to overcome the shortcomings of the prior art.

Another object of the present invention is to provide a means of accessing and storing eating utensils and cutlery that is conveniently located in the kitchen.

Another object of the present invention is to provide a means of accessing and storing eating utensils and cutlery that would not present an obstacle to normal kitchen activity whether stowed or deployed.

Yet another object of the present invention is to provide a means of accessing and storing eating utensils and cutlery that is easily accessed.

Still yet another object of the present invention is to provide a means of accessing and storing eating utensils and cutlery that is easily deployed.

Yet another object of the present invention is to provide a means of accessing and storing eating utensils and cutlery that is easily stowed.

Yet still another object of the present invention is to provide a means of accessing and storing eating utensils and cutlery that is out of sight when stowed.

Additional objects of the present invention will appear as the description proceeds.

The present invention overcomes the shortcomings of the prior art by providing a cutlery storage/knife rack that installs under a cabinet, a convenient location for constant usage. It can be mounted directly over the sink or to either side. There are also several other advantages. Undercabinet stowage keeps it out of the way as well as out of sight but still in a place that requires a minimum of movement or effort to access. The rack is secured in stowed position by a snap-in latch, which is pulled to release. It is suspended from 4 swing down hinges installed under the cabinet. The swing-down hinged feature offers an additional advantage, i.e., even when it is deployed it is suspended high enough above the countertop so as not to present an obstacle within the work area so it normally can be kept in the down position for continual use with no adverse effects. If it should occasionally represent an obstacle, it can be easily latched by simply pushing it back which swings it up into the locked position under the cabinet. This action requires very little effort or motion.

The preferred embodiment of the cutlery rack configuration comprises a base platform upon which a smaller rectangular knife rack is centrally disposed made of rock maple wood, into which a plurality of slots for holding dinner knives has been introduced. Additionally and symmetrically disposed on either side of the cutlery rack, are arrays of u-shaped holders for forks and spoons, respectively. Other embodiments include flatware holders that grasp the handles of the flatware and a device devoted exclusively to cutlery with a correspondingly larger cutlery rack.

The latching mechanism consists of a springy metallic extended member with a catch configuration at its extremity installed to the underside and near the front of the cabinet. A hooked end of the catch supports the stowed base until the catch is pulled, thus removing the hooked end from beneath the base and releasing it for downward motion.

An alternate base is provided that includes a front portion, sized to be flush to the cabinet underside, when the base is in the stowed position. In kitchens where the cabinets have no underside recess to conceal the device, this front portion serves the purpose of concealing the device from a frontal view.

The present invention therefore provides not only a novel and elegant solution to one problem of kitchen storage and utility but represents a significant improvement in the overall working and living environment of one of the most important rooms in the home.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described by way of example, with reference to the accompanying drawing in which.

DESCRIPTION OF THE REFERENCED NUMERALS

Figure 1:
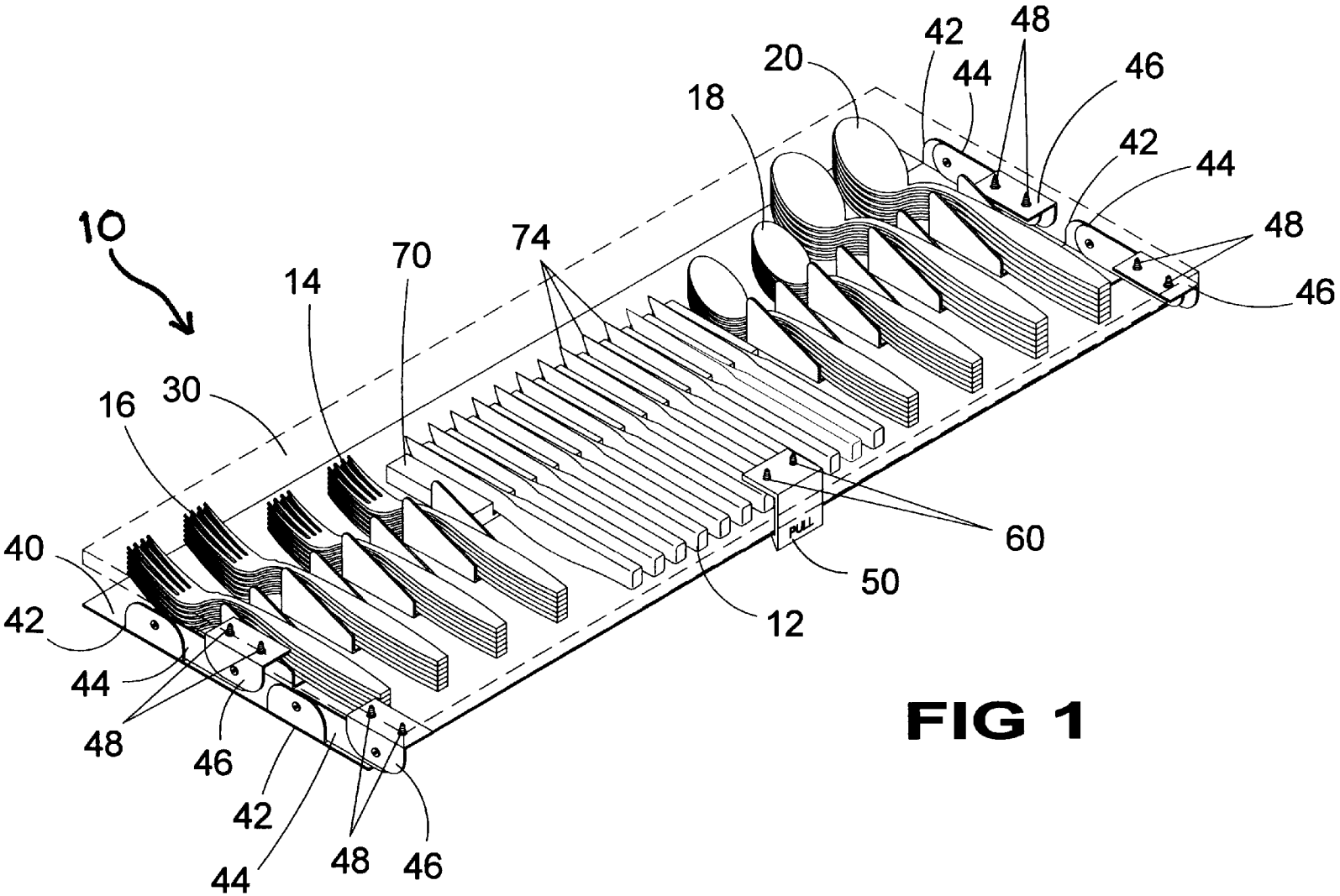
FIG. 1 is a perspective view of the present invention. Shown is the silverware rack in the stowed position under a cabinet having a plurality of eating utensils stored therein.

Turning now descriptively to the drawings, in which similar reference characters denote similar elements throughout the several views, the Figures illustrate the under cabinet culinary instrument rack of the present invention. With regard to the reference numerals used, the following numbering is used throughout the various drawing figures.

10 undercabinet culinary instrument rack of the present invention

12 knives

14 small forks

16 large forks

18 small spoons

20 large spoons

30 cabinet/shelf bottom

40 base

42 lower brackets

44 swing arm

46 upper brackets

50 catch

52 catch base

54 catch downward extension

56 catch hooked end

58 catch screw holes

60 catch screws

70 knife rack

72 knife rack grooves

74 knife blades

90 flatware holders

92 flatware holders base

94 flatware wall members

100 separation members

102 separation member spaces

110 alternate base

112 alternate base front portion

DETAILED DESCRIPTION OF THE PREFERRED EMBODIMENT

Turning now descriptively to the drawings, in which similar reference characters denote similar elements throughout the several views, FIGS. 1–12 illustrate the undercabinet culinary instrument rack of the present invention indicated generally by the numeral 10.

Figure 2:
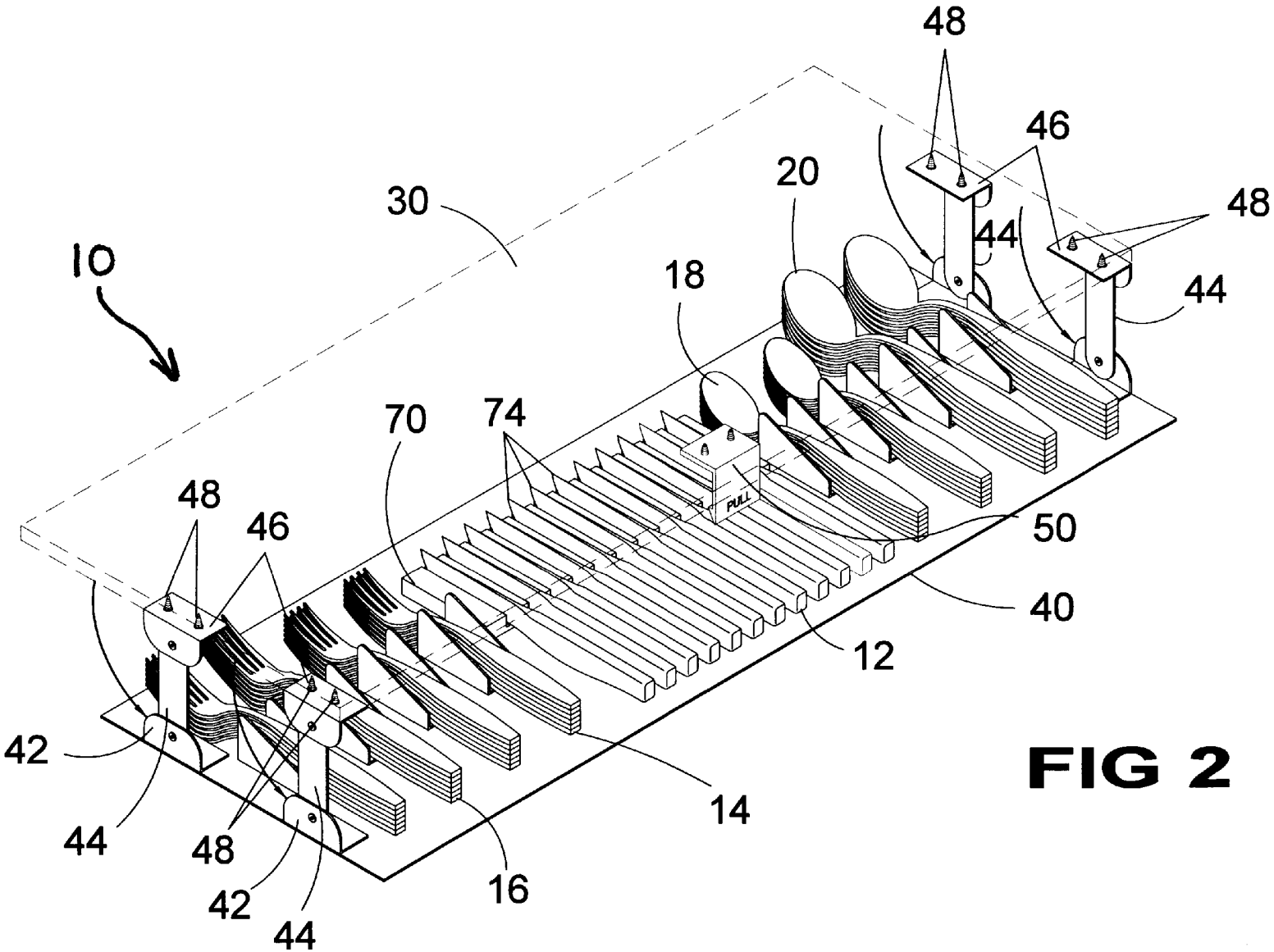
FIG. 2 is a perspective view of the present invention. Shown is the silverware rack in the extended open position under a cabinet.
Figure 3:
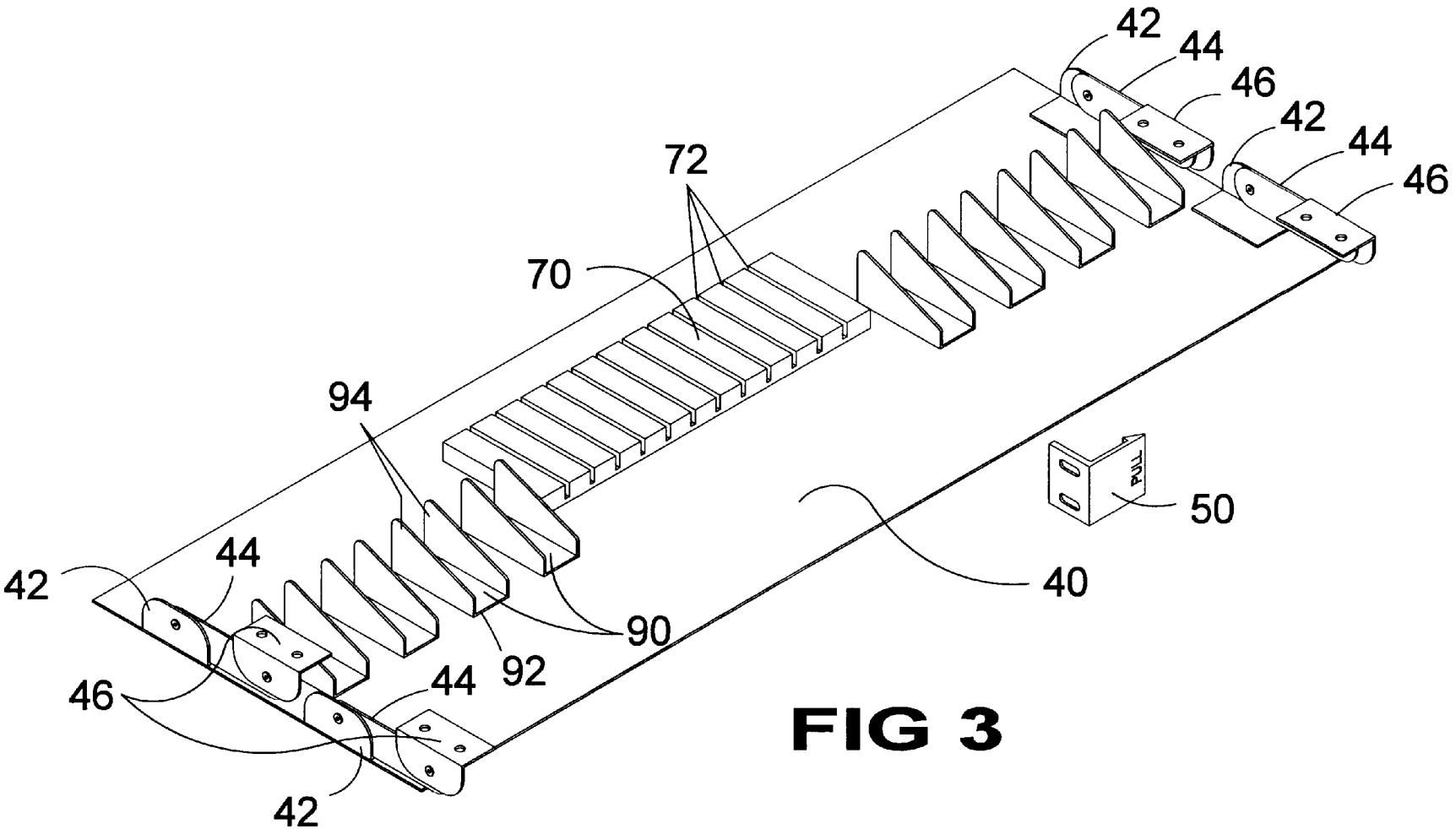
FIG. 3 is a perspective view of the present invention. Shown is the under cabinet swing down silverware rack.
Figure 4:
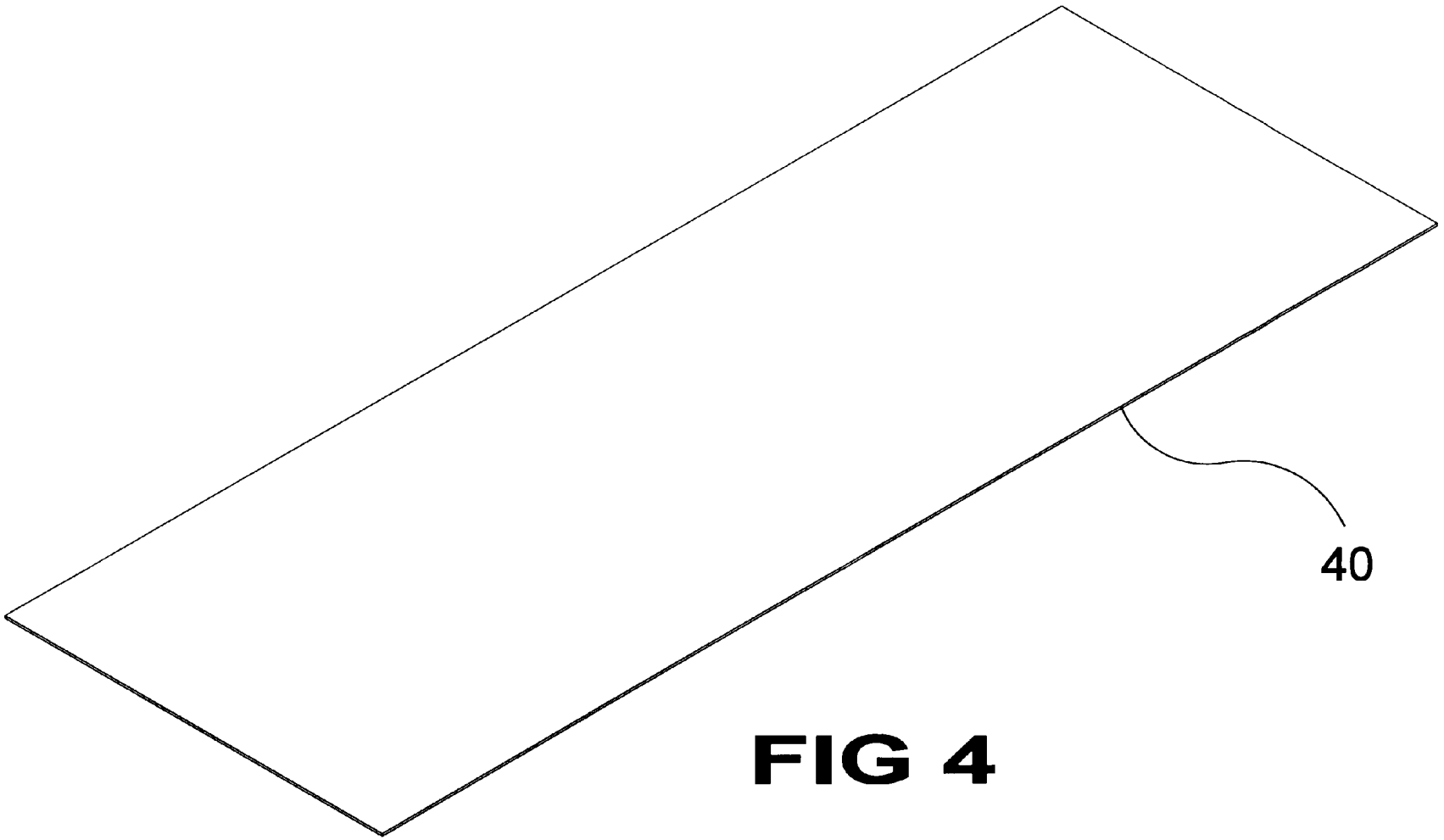
FIG. 4 is a perspective view of the planar rack base member of the present invention whereupon are fixedly attached the pivotal cabinet attachment brackets, cutlery holding member and a plurality of fork and spoon holding members.
Figure 7:
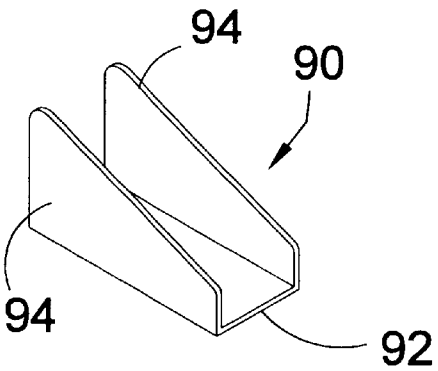
FIG. 7 is a perspective view of the fork and spoon holding member of the present invention.
Figure 6:
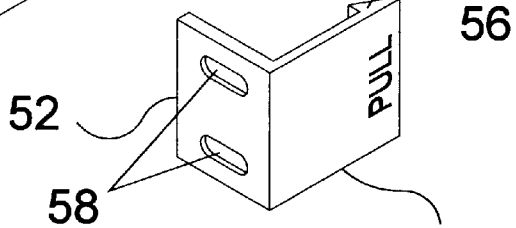
FIG. 6 is a perspective view of the catch closure member of the present invention.
Figure 5:
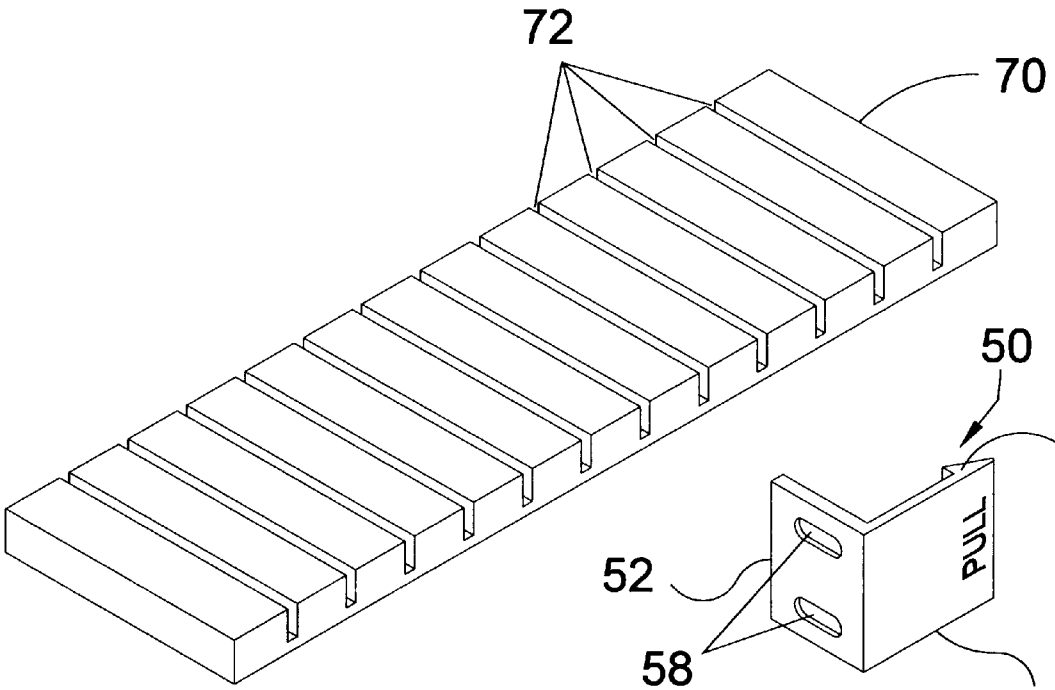
FIG. 5 is a perspective view of the cutlery holding member of the present invention.

The device 10 is shown loaded with culinary instruments such as knives 12, small forks 14, large forks 16, small spoons 18, and large spoons 20 in FIGS. 1–2. In FIG. 1 the device 10 is in its upper stowed position which is very near the cabinet bottom 30 to which the device 10 is attached. In FIG. 2 the device 10 is in its open position, which in this embodiment is both down and forward from the cabinet bottom 30.

The culinary instruments 12–20 are representative only of the various cutlery, flatware, and other relatively flat cooking and eating utensils which can be stored using the undercabinet culinary instrument rack 10.

Figure 9:
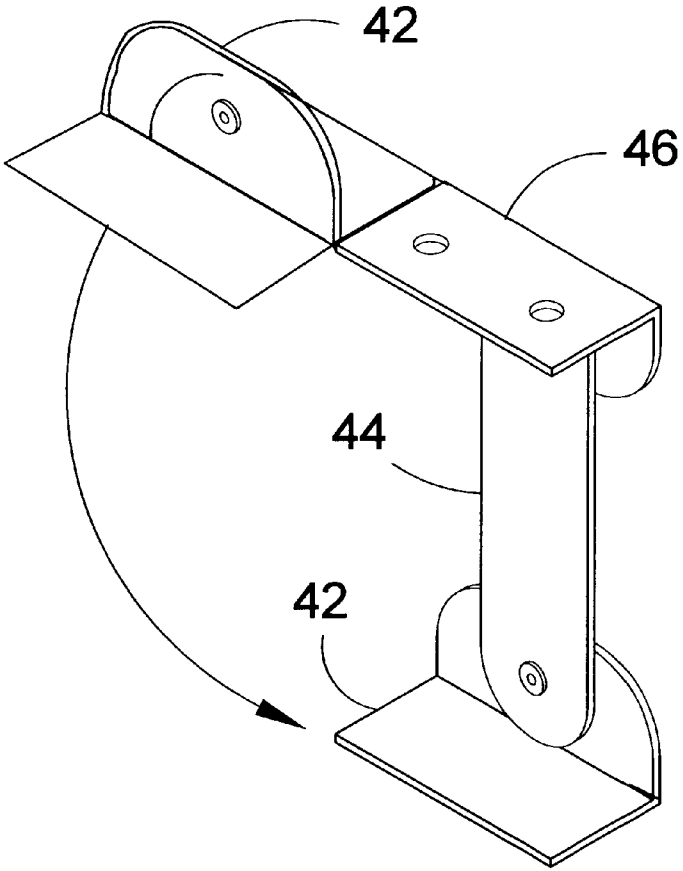
FIG. 9 is a perspective view of the other cabinet attachment bracket of the present invention in the extended position.
Figure 8:
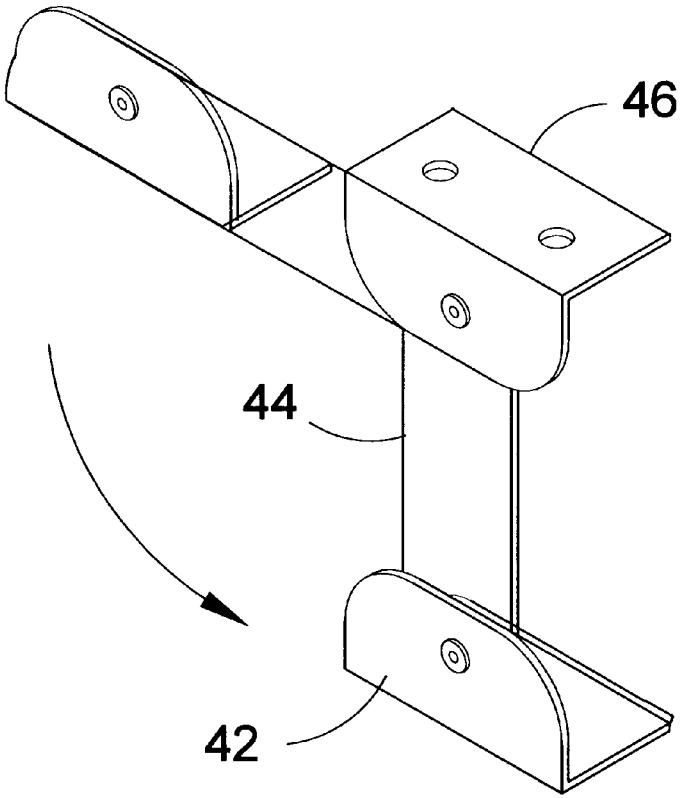
FIG. 8 is a perspective view of a cabinet attachment bracket of the present invention in the extended position.
Figure 10:
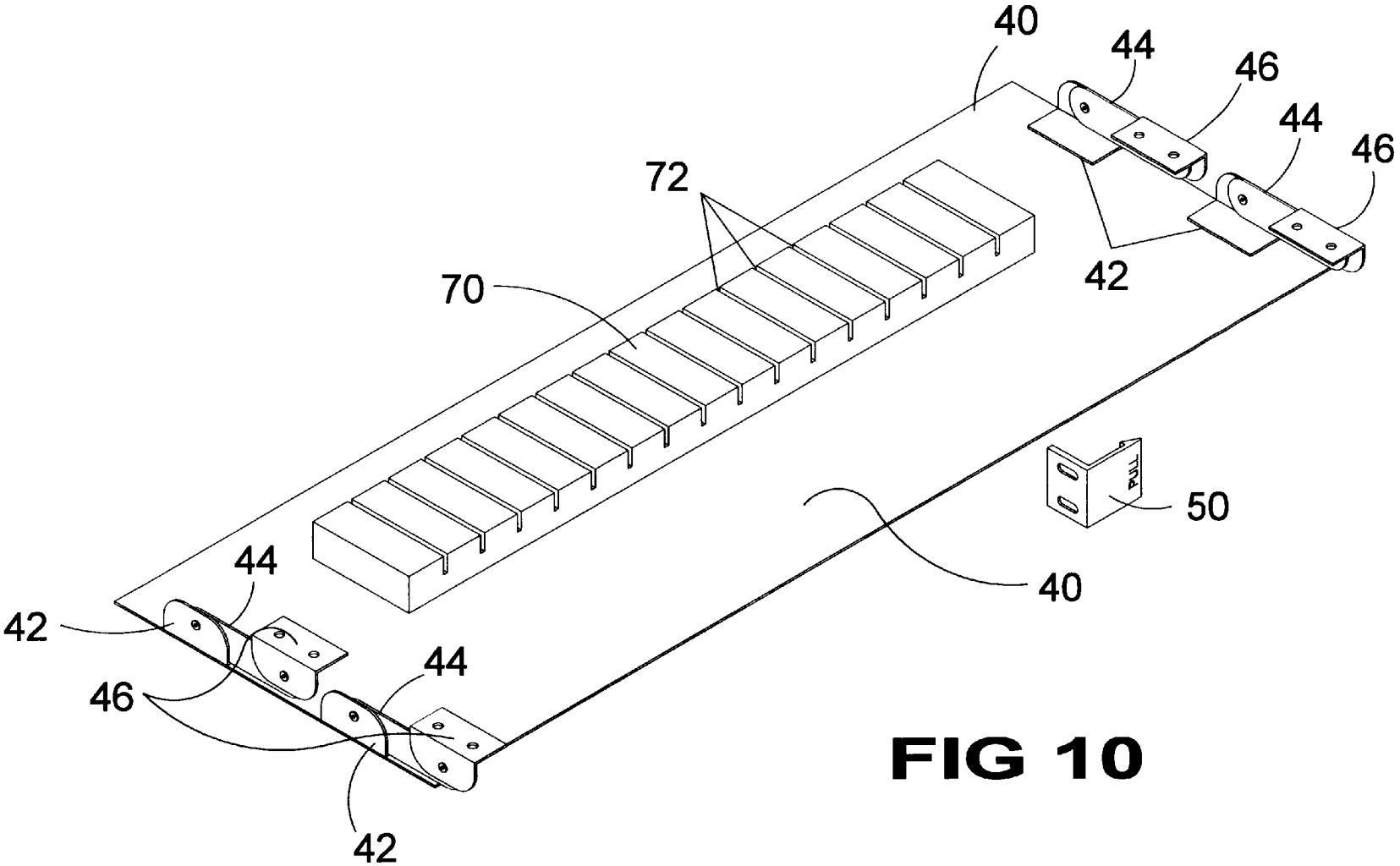
FIG. 10 is a perspective view of another configuration of the present invention. Shown is the silverware rack in the stowed position under a cabinet.

The culinary instruments 12–20 are held and organized on a base 40 which is in turn attached to four lower brackets 42. As particularly shown in FIGS. 8–9, the lower brackets 42 are hingedly attached to a swing arm 44. Four upper brackets 46 are also hingedly attached to the swing arm 44, such upper brackets 46 being affixed to the cabinet bottom 30. The hinged assembly of the lower brackets 42, upper brackets 46, and swing arms 44, allow a "swing down" movement, as best shown in FIGS. 8–9, and, when attached to the base 40, as shown in FIGS. 1–2. Screws 48 are utilized to attach the lower brackets 42 and the upper brackets 46 to the base 40 and cabinet bottom 30, respectively.

A catch 50 is provided for attachment to the cabinet bottom 30. From the catch base 52 a downwardly extending portion 54 has a tapered hooked end 56. The catch base 52 has holes 58 through which screws 60 are inserted for fastening the catch 50 to the cabinet bottom 30. The catch 50 is positioned such that the forward edge of the base 40 encounters the taper of the tapered hooked end 56 as the base 40 moves toward its upper position. This encounter temporarily deforms the resilient hook extended portion 54 allowing passage of the base 40. Once passed, the forward edge of the base 40 rests on the top of the tapered hooked end 56. The base 40 is held in this position until the catch downward extension 54 is grasped by hand and deformed until the base 40 can move toward its open position without encountering the catch 50.

In other embodiments, damped hinges are provided, which secure the base 50 in the stowed position without the use of a catch. In such embodiments, the base 50 would be pulled into the open position.

When the base 40 is in the upper position, it is substantially parallel to the cabinet bottom 30, and this relationship continues during the movement to the down position.

As shown in FIGS. 1–3,5,10, a knife rack 70 is centrally positioned on the base 40, and has a plurality of grooves 72 that support and secure the knife 12, when the knife blade 74 is placed within the groove 72. The grooves 72 are substantially parallel, can be vertical or slanted, and have a sufficient length to keep the entire knife 12 aligned with the groove 72. Thus when several knives 12 are so positioned they will be separated and parallel. In other embodiments, the grooves 72 can be replaced by enclosed slots.

A flatware holder 90 is provided in this embodiment, as shown in FIGS. 1–3,7. Spoons 18,20 and forks 14,16 of various sizes are particularly suitable for placement in the holder 90, although knives 12 can also be accommodated. The holder 90 in this embodiment has a base 92 and two substantially parallel wall members 94. The holder wall members 94 are spaced to accept the handles of such flatware 14–20, although the tine member of the forks 14,16 and the bowl members of the spoons 18,20 are wider than such a space.

In another embodiment, the holder wall members 94 are of such a height that they contact the cabinet bottom 30 when the base 40 is in the stowed position. This contact forms an enclosure about each culinary instrument group, consisting of the cabinet bottom 30, the holder base 92, and the two holder wall members 94.

Figure 11:
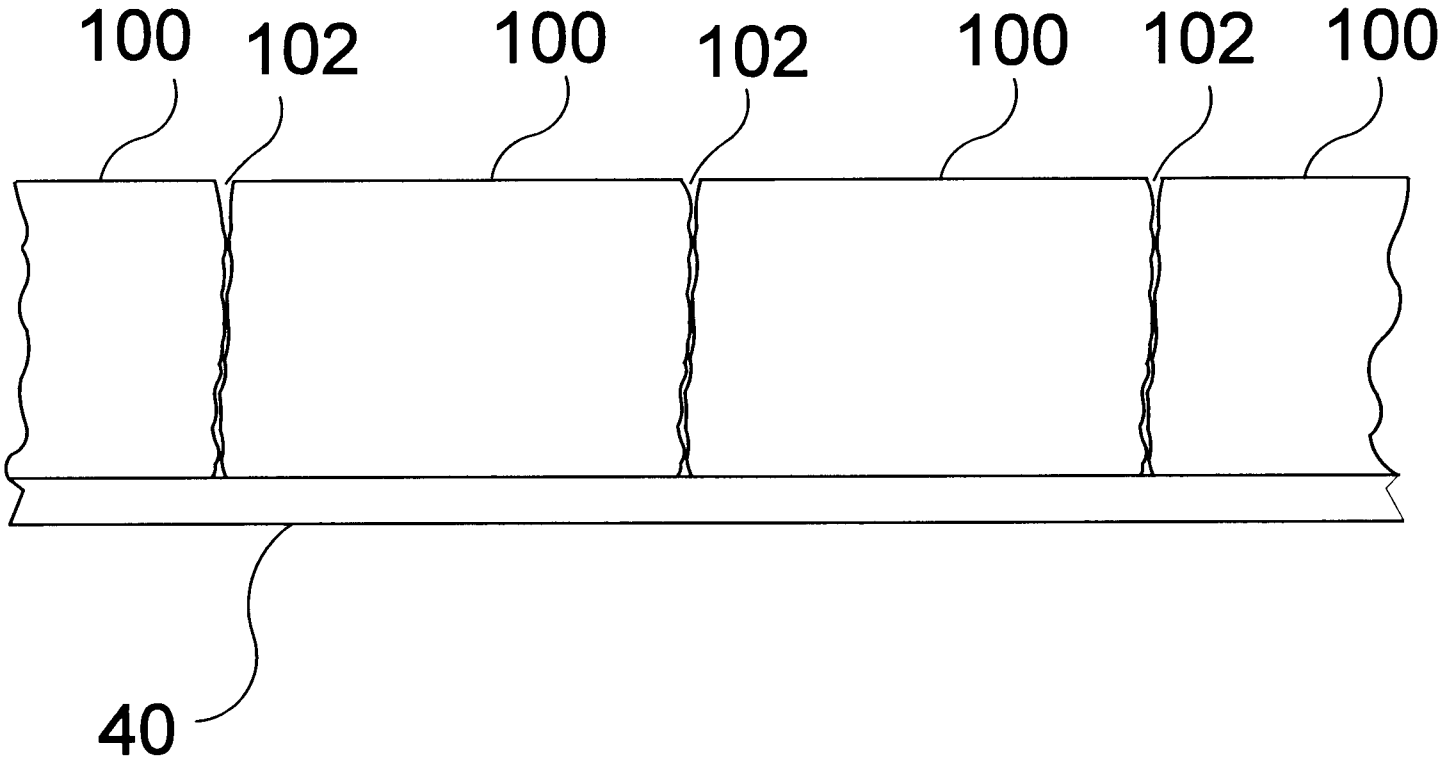
FIG. 11 is a front view of a portion of an alternate base and flatware separation members that are constructed and spaced so as to grasp the handle of flatware pieces or stacks of flatware pieces.

In other embodiments, a plurality of flatware separation members 100 are provided, as shown in FIG. 11, which provide a plurality of spaces 102 which retain the flatware 12–20. In such other embodiments, the separation members 100 can be spaced such that the flatware 12–20 handles must be pushed into the spaces 102. When so inserted the flatware 12–20 handles are grasped by the separation members 100. Separation members 100 that grasp the handles of the flatware 12–20 can be made from various plastics or foam rubber.

Figure 12:
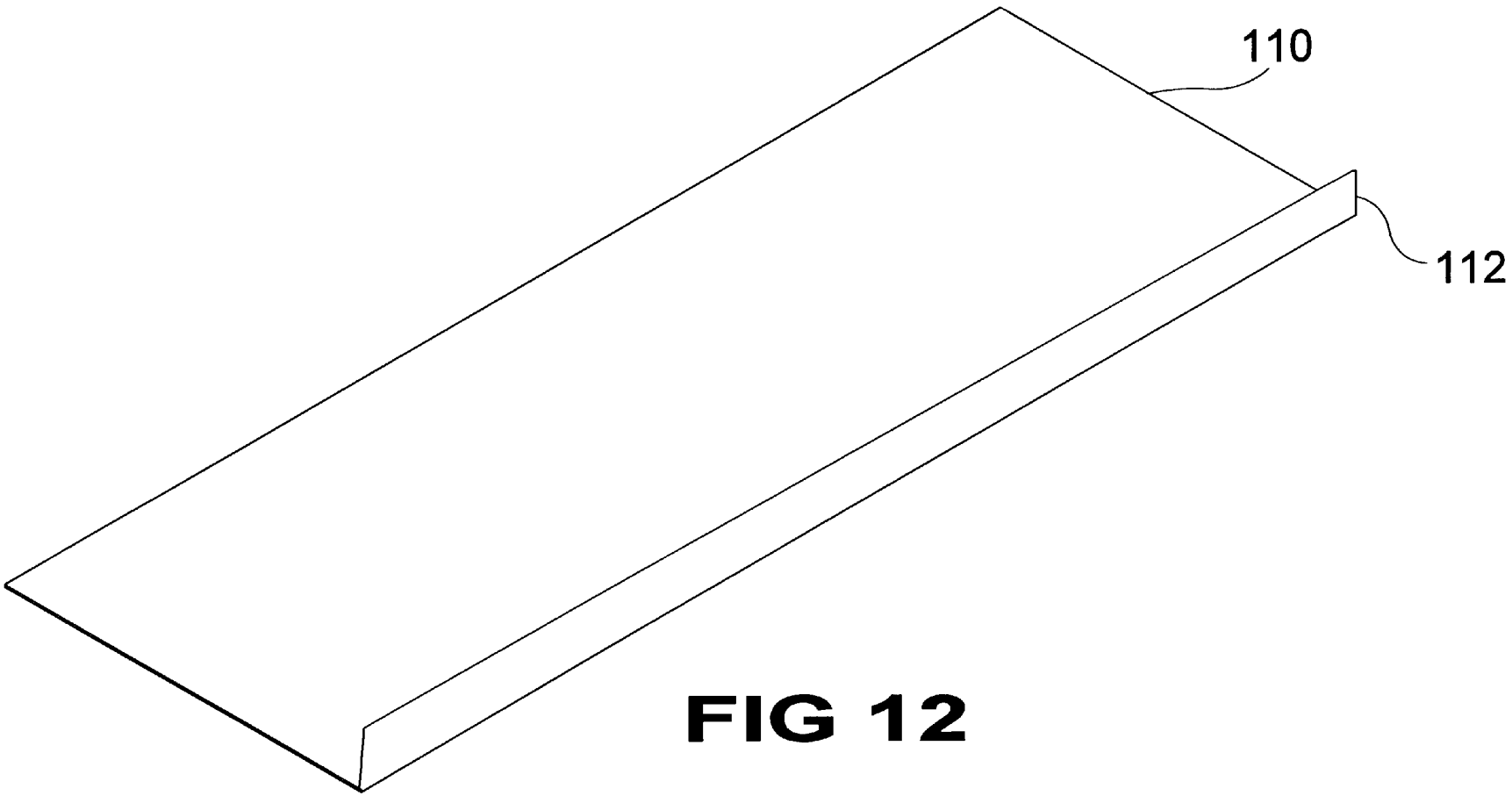
FIG. 12 is a perspective view of an alternate base that has a front portion extending upwardly such that it is flush with the cabinet or shelf bottom when the base is in the stowed position.

The base 40 and the brackets 42,46 are sized such that the device 10 is concealed within the recess often formed on the underside of a kitchen cabinet. In some cases, however, the cabinet bottom 30 is not above such a recess. FIG. 12 depicts an alternate base 110 that has an upwardly extending front portion 112. The front portion 112 conceals the culinary instruments 12–20 and other contents of the device 10, from a frontal view, in those situations where the cabinet has no underside recess. The front portion 112, as well as, the base 40,110 can be stained or otherwise adapted to match kitchen decorative elements. The front portion 112 can be sized to be flush against the cabinet bottom 30 when the base 110 is in the stowed position, thus enhancing the concealment. Similarly, an upwardly extending side portion could be utilized for concealment on end cabinets, when it is desired that a side view be concealed as well.

Although particular materials and types of fasteners have been discussed, such materials could also include rock maple wood, other woods, fiberglass, and glass, and the fasteners could also include adhesives, tape and bolts, all in accordance with the present invention, and as determined by the intended end use for the overall device, as will occur to those of skill in the art upon review of the present disclosure.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for storing culinary instruments proximate the underside portion of a cabinet or shelf, comprising:

(a) a base;

(b) a pair of left mounts and a pair of right mounts, each mount having an arm and first and second brackets, the brackets being hingedly attached to the arm, the first bracket being attached to the base, and the second bracket adapted to be attached to the underside portion, such that the base is alternately movable between an upper stowed position and downward into an open position; and (c) a plurality of separation members attached to the base, the separation members being substantially parallel and adapted to receive and separate two or more culinary instruments; and (d) a catch, the catch adapted to be attached to the underside portion, the catch having a flanged end, the catch being positioned such that the flanged end engages and retains the base when the base is moved to the stowed position.

2. The device of claim 1, wherein the base moves from the stowed to the open position under the weight of the base alone.

3. The device of claim 1, wherein the mounts are hingedly damped, such that the weight of the base and the culinary instruments do not move the base from the stowed to the open position.

4. The device of claim 1, wherein the base is adapted to be substantially parallel to the underside portion in both the stowed and open positions.

5. The device of claim 1, further comprising a rack portion, the rack portion having a plurality of substantially parallel grooves, the grooves being adapted to closely receive a plurality of knife blades, such that the knives are aligned and separated.

6. The device of claim 1, wherein the separation members are spaced such that the neck of a culinary instrument is capable of being grasped between any two of the separation members.

7. The device of claim 1, wherein at least two separation members are adapted to contact the underside portion when the base is in the stowed position.

8. The device of claim 1, further comprising a front portion attached to the base such that the culinary instruments are prevented from sliding forward from between the separation members.

9. The device of claim 8, wherein the front portion is adapted to be substantially flush against the underside portion when the base is in the stowed position.

10. A device for storing culinary instruments proximate the underside portion of a cabinet or shelf, comprising:

(a) a base;

(b) a pair of left mounts and a pair of right mounts, each mount having an arm and first and second brackets, the brackets being hingedly attached to the arm, the first bracket being attached to the base, and the second bracket adapted to be attached to the underside portion, such that the base is alternately movable between an upper stowed position and downward into an open position; and (c) a plurality of separation members attached to the base, the separation members being substantially parallel and adapted to receive and separate two or more culinary instruments;

(d) a rack portion, the rack portion having a plurality of substantially parallel grooves, the grooves being adapted to closely receive a plurality of knife blades, such that the knives are aligned and separated; and (e) a catch, the catch adapted to be attached to the underside portion, the catch having a flanged end, the catch being positioned such that the flanged end engages the base when the base is moved to the stowed position.

* * * * *